US006749019B2

(12) United States Patent
Liu

(10) Patent No.: US 6,749,019 B2
(45) Date of Patent: Jun. 15, 2004

(54) AUTOMATIC PARAFFIN REMOVAL UNIT

(76) Inventor: Xiaoyan Liu, No. 173, Minzhuping, Shuangbei, Shapingba, Chongqing 400032, P.R. (CN)

( * ) Notice: Subject to any disclaimer, the term of this patent is extended or adjusted under 35 U.S.C. 154(b) by 0 days.

(21) Appl. No.: 10/042,824

(22) Filed: Jan. 7, 2002

(65) Prior Publication Data

US 2002/0088617 A1 Jul. 11, 2002

(30) Foreign Application Priority Data

Jan. 8, 2001 (CN) ..... 01102824 A
Jan. 8, 2001 (CN) ..... 01202946 U

(51) Int. Cl.[7] ..... E21B 37/02
(52) U.S. Cl. ..... 166/172; 166/176
(58) Field of Search ..... 166/170, 172–176, 166/177.3

(56) References Cited

U.S. PATENT DOCUMENTS 3,981,364 A * 9/1976 Warner et al. ..... 166/311
5,168,929 A * 12/1992 Galloway ..... 166/304

FOREIGN PATENT DOCUMENTS

CN 1067703 A 1/1993

* cited by examiner

*Primary Examiner*—Zakiya Walker
(74) *Attorney, Agent, or Firm*—Knobbe, Martens, Olson & Bear, LLP

(57) ABSTRACT

An automatic paraffin removal unit, including a scraper body, a tumbler, an arc spring leaf and a return torque spring, and the upper and lower commutators having a sleeve, an open spacing ring and a tower spring. In operation, the scraper is clamped on a pumping rod, while the upper, lower commutators are respectively connected to the upper, lower ends of the tubing section from the well head to the section having toe temperature lower than paraffin deposition temperature requiring paraffin removal. The scraper moves up and down following the pumping rod via unidirectional upward or downward movement, paraffin removal being performed to the inner wall of tubing and pumping rod unceasingly, and variations in direction being performed in the upper, lower commutators.

29 Claims, 5 Drawing Sheets

AUTOMATIC PARAFFIN REMOVAL UNIT

RELATED APPLICATIONS

This application claims the benefit of the Chinese applications 01102824.6 and 01202946.7 both filed Jan. 8, 2001.

BACKGROUND OF THE INVENTION

1. Field of the Invention

The invention relates to a paraffin removal unit, more particularly to an automatic paraffin removal unit.

2. Description of the Related Art

In oil exploitation, from a bottom hole to the ground, pressure, temperature of underground crude are gradually lowered, while the paraffin molecules in the crude gradually solidify, deposit on the inner wall of oil tubing and pumping rod, diameter of the oil tunnel is gradually contracted, even blocked, and crude output is reduced even stopped in production. In order to exploit the crude from the bottom hole freely, periodical paraffin removal must be performed for the oil tubing and pumping rod. Paraffin removal methods in prior art comprise: (1) Hot melt, high temperature heated crude oil being injected into the oil well from the ground, to meet the deposited paraffin although the method is prevailing but massive crude and energy should be consumed, and a set of dedicated equipment is needed, a specially-assigned person has to be in charge of management, thereby oil exploitation cost is increased; (2) Mechanical paraffin removal, multiple scrapes are mounted on the pumping rod to scrape off paraffin, since a plurality of scrapers are installed, effluent oil being obstructed, not only increased equipment cost, but also added the load of oil pump; (3) Strong magnetic anti-paraffin de position, a strong magnetic means for anti-paraffin deposition mounted at the paraffin deposited segment in oil well, carries out magnetic treatment to effluent oil by the magnetic field of a permanent magnet in the section, to modify the molecular structure of paraffin in the oil, delay paraffin deposition, however, the method is inefficient and is chiefly discarded; (4) Chemical paraffin removal, specially-made chemical solvent is injected into an oil tubing, melts the paraffin to achieve the purpose of paraffin removal, but the cost of the method is still high. The maximum defect of periodical paraffin removal is between the two removals, paraffin deposited on the wall of oil tubing and pumping rod gradually increases, so that flow through resistance of crude increased, load of the oil pump is enlarged, pump efficiency is lowered, and the cost is up. The invention patent application titled "Oil Well Pole-climbing Cleaner" is disclosed on Jan. 6, 1993 in the China Patent Gazette, with the disclosed number of CN 1067703A. The technology has the following problems: first is the tooth-tips of gearing change of a tumbler mounted on a pressure pad spring produces serious scuffing to the pumping rod, and its strength is grievously injured; second is that the tooth-tips of short gear teeth on both sides of the tumbler are in the shape of a straight line, and in point contact with the inner wall of tubing, being poor in anti-collision, and are easily worn-out, resulted in serious scuffing to the inner wall of oil tubing, after the tumbler tooth-tips are worn-out, the scraper slides to and from at the original position, cannot move up and down, and lost the function of automatic paraffin removal; third is a washer must be mounted on every tubing joint, otherwise when the scraper is passing over the joint, under the action of rebound inertia force from the return spring, tooth-tip of the tumbler inserting into the entry of oil tubing being clutched, and lost the function of paraffin removal; since the tubing joint is cone-shaped, screw-in depth is affected by the screwing force and machining accuracy, caused the screw-in depth of each tube to be different, hence washers of different fabricated length are needed in adaptable, the operation is tedious and difficult and hard in implementation.

SUMMARY OF THE INVENTION

The present invention is made to solve the above mentioned problems and overcome the drawbacks in the prior art. Accordingly, an object of the present invention is to provide a paraffin removal unit having a reasonable structure, which is convenient in mounting and use, able to perform automatic running reliably, and has a prolonged service life.

The foregoing and other objects of the present invention are achieved by providing a paraffin removal unit, comprising: a scraper clamped on the pumping rod and the upper and lower commutators connected to both end of the tubing segment requiring paraffin removal from well head to the section having a temperature lower than the paraffin deposition temperature; the scraper comprises a scraper body, a tumbler, an arc spring leaf, and a return spring, three sheets of arc spring leaves are mounted on the upper and lower ends of the scraper body, their relative positions are staggered with 60 degrees, to completely remove the paraffin deposited on the pumping rod; on the circle of scraper body, over three rows of rectangular through-holes and I-shaped slots in staggered arrangement are opened, and screw cutting edges whose positions staggered in 60 degrees are located at both ends; round pits having staggered positions are located on both sides of the I-shaped slots, when the steel spacing balls mounted on the tumbler slip into the round pits, i.e. spacing for the tumbler is realized, inward notched grooves are located on upper and lower sections of the I-shaped slots, the return torque springs are mounted symmetrically in the grooves, enable the short tooth-tips of tumbler to be adjoined to the inner wall of oil tubing; in which a tumbler is mounted at the middle of I-shaped slot, the tooth-tips of short gear teeth on both sides of the tumbler are arc-shaped, whose radius of circular arc is approximate to the tubing radius, and the middle gear tooth on the tumbler has a round angle, to reduce scuffing to the inner wall of oil tubing, meanwhile the anti-collision ability of tooth-tips is enhanced.

The upper and lower commutators comprises a sleeve an open spacing ring, and a tower spring, in which the open spacing ring of the tumbler is mounted in the upper cone cannelure of the sleeve, the scraper is not allowed to pass over, the tower spring is inverted in the cone cannelure mounted at the lower section of the sleeve, and the tooth-tips are not worn-out to realize commutation of every tumbler.

In order to restrict the position of the tumbler when the return spring rebounds to free state, a through-hole is fabricated nearby the mounting hole of tumbler, a spacing spring is mounted in the hole, a steel spacing ring is mounted on each of both ends of the hole respectively, when the steel spacing ball slips into a round pit on both sides of I-shaped notch on the scraper, then the tumbler's position is restricted. A sinkhole having a diameter larger then that of the mounting hole fabricated on an end of the mounting hole of tumbler can also be employed, a round spring is mounted in the sinkhole, and appropriate limitation is performed to the tumbler position or to add a pressed spring in tubing joint to limit inverted turn of the tip of tumbler.

In order to prolong the service life of paraffin removal unit, wear-resistant material being inlaid on an end of every sheet of arc spring leaf.

Since the invention improved the shape of middle and short teeth on both sides of the tumbler, scuffing to the tubing inner wall is avoided, anti-collision ability of the tumbler is enhanced, and its service life is prolonged, an end of arc spring leaf is inlaid with wear resistant material, thereby the service life is extended, since a member for restriction of the tumbler position is mounted, no washer is needed at the middle section of tubing joint on passing over the tubing joint into a next tubing, the scraper shall not be clutched; since tower springs are mounted in the upper, lower commutators of the invention, every commutator switches over smoothly, the scraper runs successfully up and down, multiple paraffin removals can be performed for oil tubing and pumping rod daily, crude is smoothly exploited and the pump efficiency is not lowered, high paraffin removal cost is saved, and distinct economic effect being achieved.

BRIEF DESCRIPTION OF THE DRAWINGS

The above and other objects and advantages of the invention will become apparent and readily appreciated from the following description of the preferred embodiments, taken in conjunction with the accompanying drawings of which:

FIG. 6 shows the configuration of the tumbler, wherein

FIG. 7 shows the tumbler in an assembled state, wherein FIG. 7B is a sectional view of FIG. 7A taken along the line B—B;

FIG. 8 shows the configuration of another tumbler, wherein

DETAILED DESCRIPTION OF THE PREFERRED EMBODIMENTS

Figure 1:
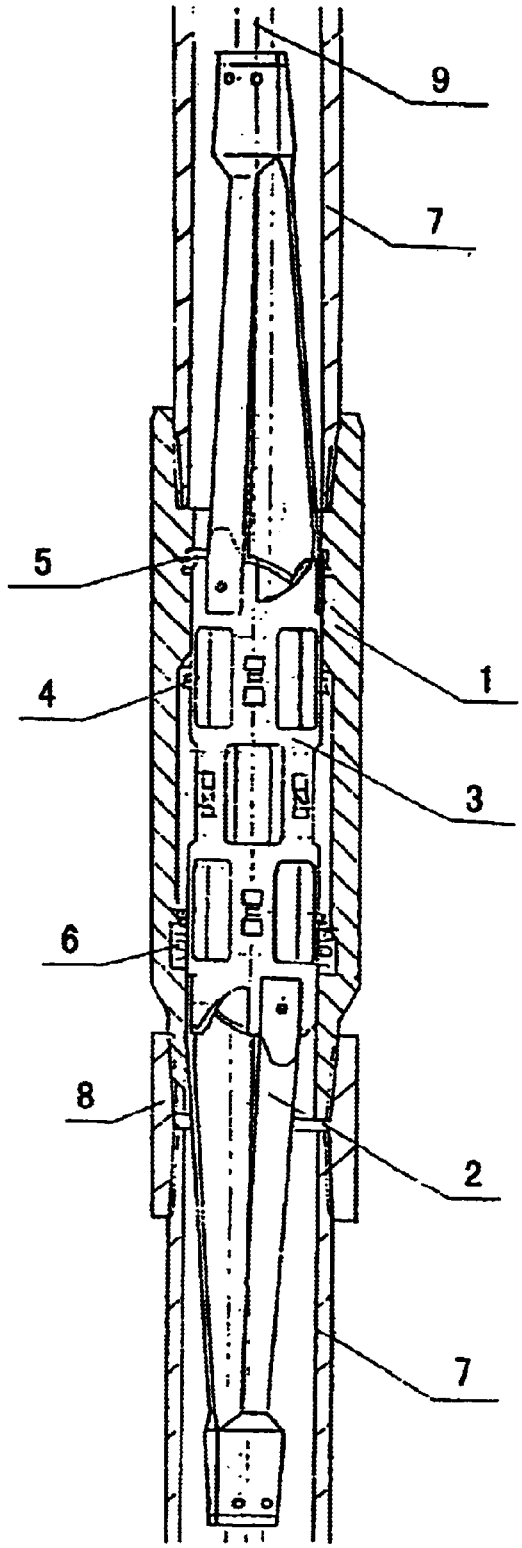
FIG. 1 is a schematic showing operation state of the invention.
Figure 2:
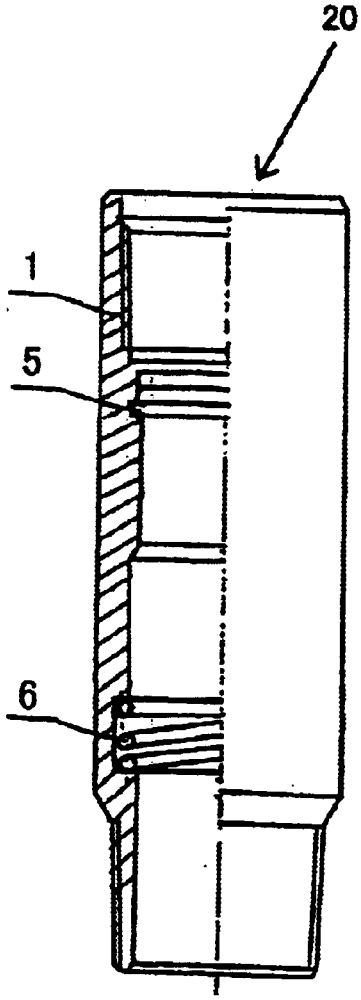
FIG. 2 is a schematic view of one of the upper and lower commutator according to an embodiment of the present invention, wherein the commutator is in an assembled state.
Figure 3A:
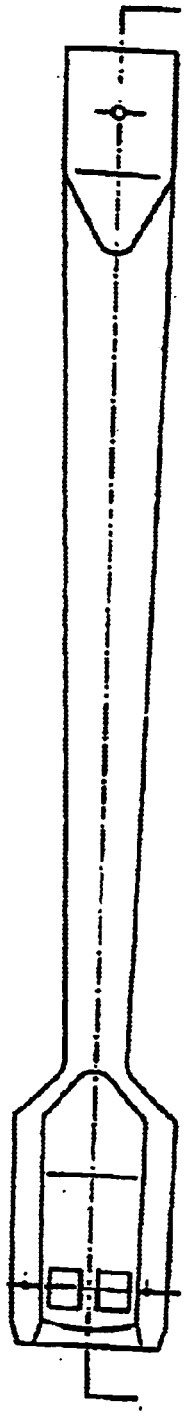
FIGS. 3A and B show an embodiment of an arc spring leaf in front and side views respectively.
Figure 3B:
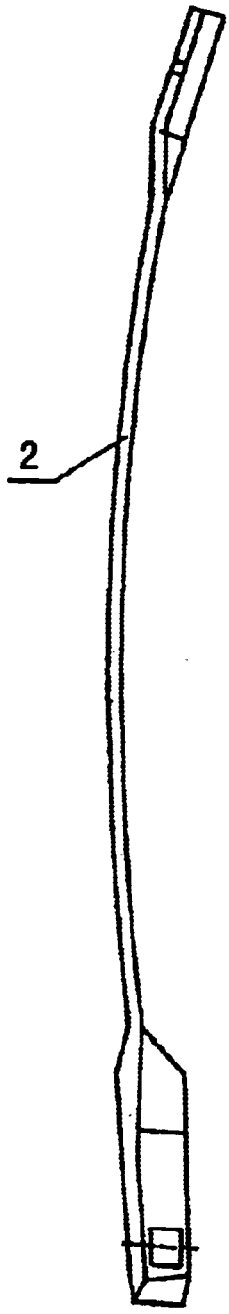
Figure 4A:
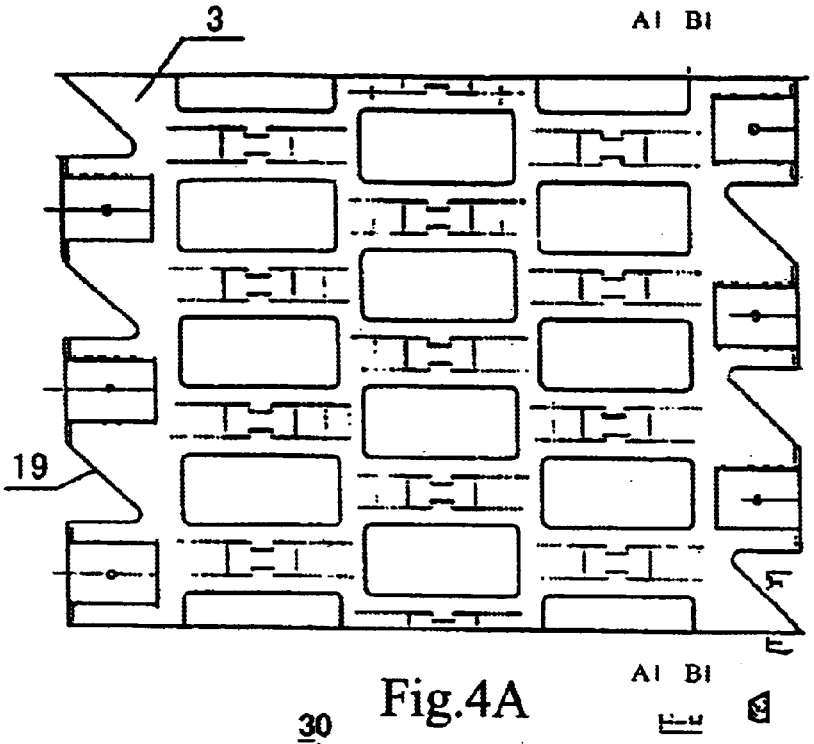
FIGS. 4A and B is an exploded diagram and cross sectional views of the scraper body respectively.
Figure 4B:
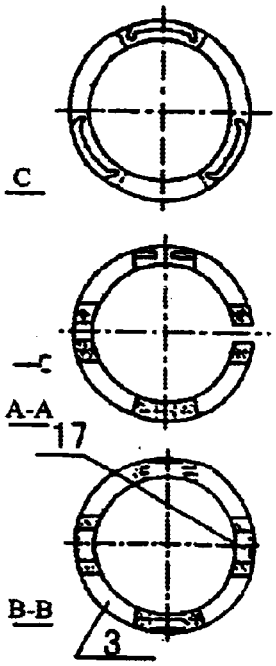
Figure 5A:
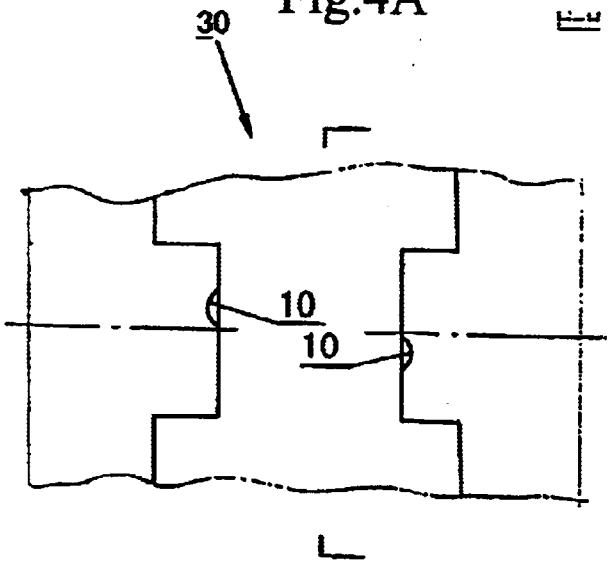
FIGS. 5A and B show the round pit position on both sides of I-shaped notch on the scraper body.
Figure 5B:
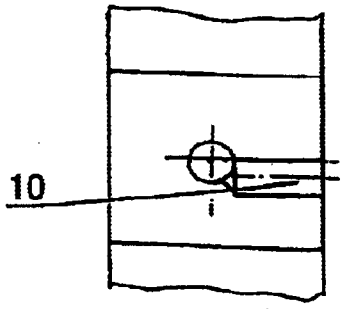
Figure 6A:
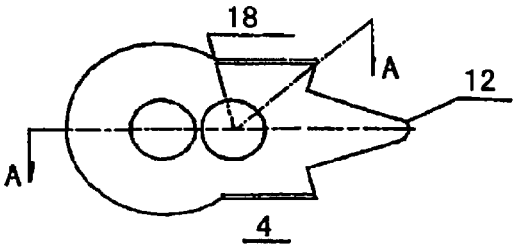
FIG. 6A is a front view of the tumbler.
Figure 8A:
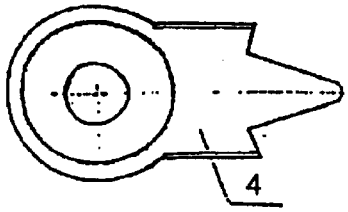
FIG. 8A is a front view of the tumbler.
Figure 6B:
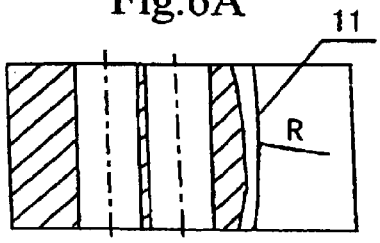
FIG. 6B is a sectional view of FIG. 6A taken along the line A—A.
Figure 8B:
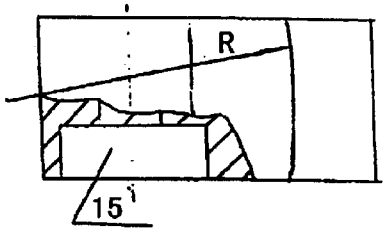
FIG. 8B is a plan view of FIG. 8A.
Figure 7A:
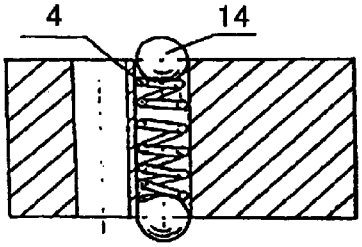
Figure 7B:
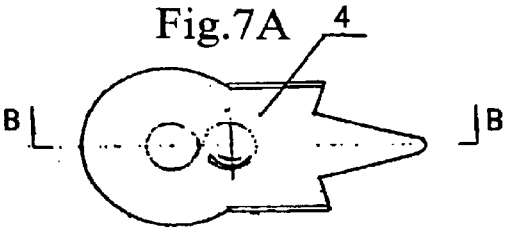
FIG. 7B is a front view of the tumbler.
Figure 9:
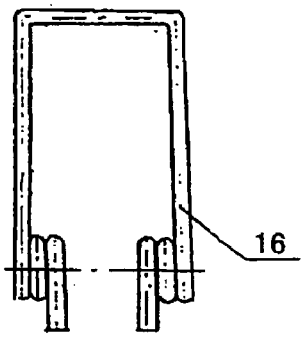
FIG. 9 is a structural diagram of return spring.
Figure 10:
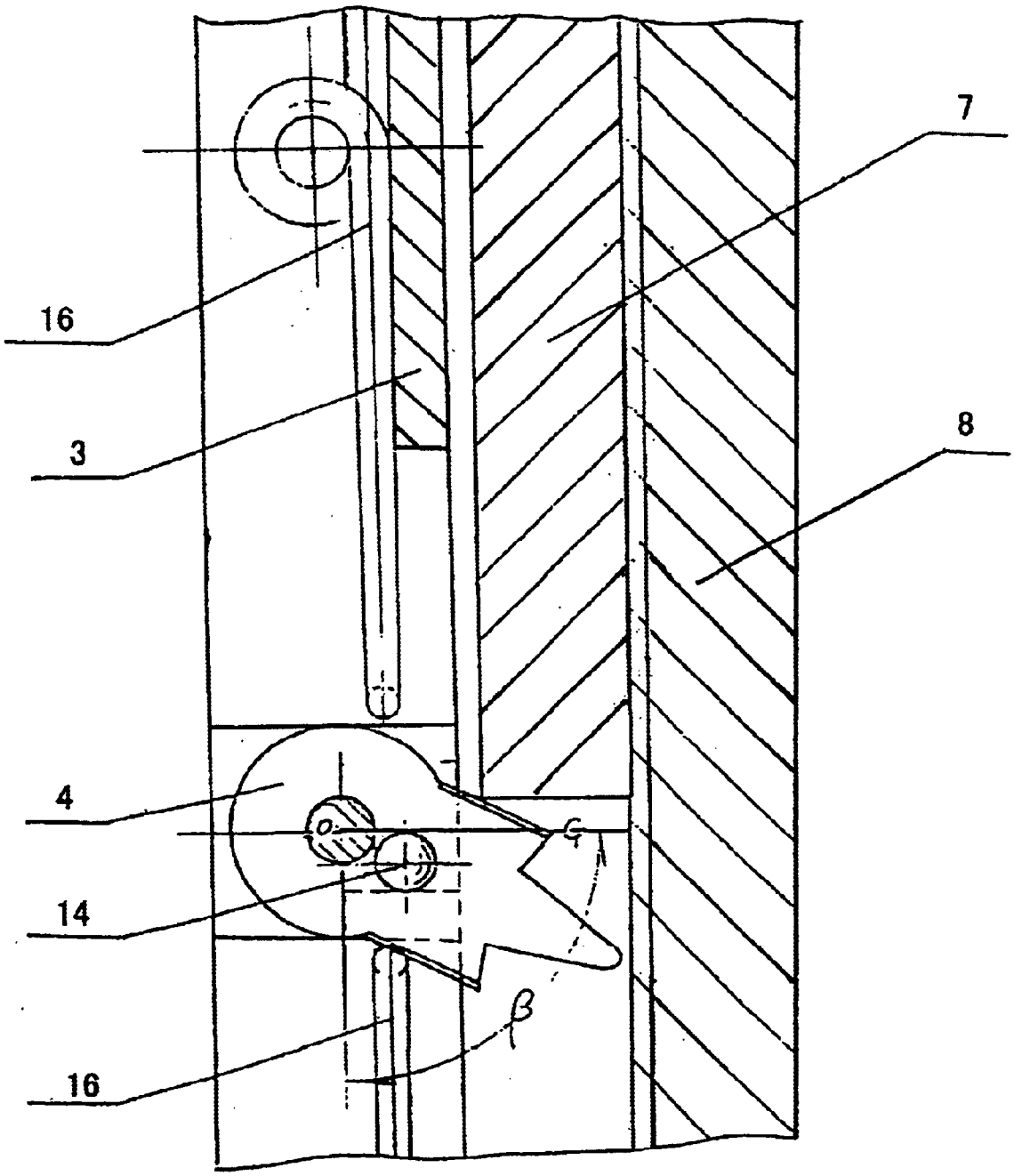
FIG. 10 is a rotation schematic of the tumbler when the scraper is passing over the oil tubing joint.

The invention is further described incorporating with the drawings as follows. First the upper and lower commutators 20 having the same configuration and each including a sleeve 1, an open spacing ring 5 and a tower spring 6 are connected to the upper and lower ends from the well head to the segment of oil tubing 7 to be cleaned having a temperature lower than the paraffin deposition temperature, then the scraper is gripped on the pumping rod 9, all the tooth-tips of tumbler 4 are turned upwards, the scraper follows the pumping rod enters into the segment of oil tubing 7 to be paraffin removed from the upper commutator 20, and the installation is completed.

When the pumping rod 9 moves downwards, the scraper moves downwards following the pumping rod 9, the lower end cutting edge 19 of scraper body 3 removes the paraffin from the inner wall of oil tubing 7. When the pumping rod 9 moves upwards, due to unidirectional action of tumbler 4, the scraper cannot move upwards to follow the pumping rod 9, relative sliding generated between pumping rod 9 and the arc spring leaves 2 on both ends of the scraper, i.e. paraffin removal by arc spring leaves 2 to pumping rod 9 is performed, pumping rod 9 performs up and down reciprocating movement, the scraper carries out paraffin removal to the inner wall of tubing and pumping rod 9 unceasingly, meanwhile moves from the upper end to the lower end along the tubing.

When the scraper passes over the tubing joint 8, since the return spring 16 mounted in the groove 17 on the upper and lower sections of the I-shaped notch 30 of scraper body 3 rebounds to free state, tumbler 4 shall continue to rotate under the action of return torque spring inertia force, at this moment the angle B between the gear teeth of tumbler 4 and axial direction is restricted via the spacing spring 13 mounted in the through-hole 18 on the tumbler 4 to push steel ball 14 to slip into the round pit 10 on a side of I-shaped notch 30 on scraper body 3, enables the angle B of the tumbler 4 contacting with return spring 16 in free state to be less or equal to 90 degrees, to guarantee the scraper not to be clutched for passing over tubing joint 8 smoothly. Position restriction to tumbler 4 can also be realized by employing the sinkhole 15 fabricated on an end of mounting hole on tumbler 4 and a round spring mounted in the sinkhole 15. Following the up and down reciprocating movement of pumping rod 9 continuously, the scraper also moves downwards in pace with the pumping rod 9, when it enters the lower commutator 20, the scraper first passes over the tower spring 6 mounted in the upper cannelure of sleeve 1, then pushes the open spacing ring 5 mounted in the inverted cone cannellure at the lower section of sleeve 1 to move downwards, due to the action of inverted cone cannelure, the diameter of open spacing ring 5 gradually reduces, when it is reduced to be less than the diameter of scraper body 3, the scraper does not move downwards following the downward movement of pumping rod 9, while it can move upwards following the upward movement of pumping rod 9, when moving upwards passes over the tower spring 6, all the tumbler gear teeth changed direction and declined downwards, thus the scraper can continue to move upwards following the upward movement of pumping rod 9, the cutting edge 19 on the upper end of scraper body 3 removes paraffin from the inner wall of tubing, when the pumping rod 9 moves downwards, the scraper does not move downwards accordingly, at this time relative sliding is generated between the pumping rod 9 and arc spring leaf, i.e. paraffin removal is performed for pumping rod 9, following the up and down movement of pumping rod 9, the scraper moves up step by step, after enters into upper commutator 20, it changed direction and moves downwards, thus the process is repeated again and again, and the scraper moves up and down to perform automatic paraffin removal to the inner wall of tubing and pumping rod for many times per day. Since the tooth-tips of short gear teeth on both sides of tumbler 4 are in the shape of arc 11, its radius is, approximate to the tubing radius, tooth-tips of middle round teeth on tumbler 4 are in the shape of round angle 12, scuffing to the inner wall of tubing is avoided, which enhanced the anti-collision and wear resistant ability of tooth-tips, and prolonged service life.

What is claimed is:

1. An automatic paraffin removal unit comprising a scraper gripped on a pumping rod and upper and lower commutators connected to both ends of a tubing segment from a well head to a section having a temperature lower than a paraffin deposition temperature which requires paraffin removal, wherein the scraper comprises:

a scraper body, a tumbler, an arc spring leaf, and a return torque spring, wherein three sheets of the arc spring leaves are mounted on both upper and lower ends of the scraper body such that their relative positions are staggered for 60 degrees over three rows of staggered rectangular through-holes, and wherein I-shaped notches are opened on a circle of the scraper body, and wherein screw cutting edges having positions staggered 60 degrees are mounted on both the upper and lower ends in which staggered round pits are mounted on both sides of the I-shaped notches, and wherein inward slotted grooves are opened at the upper and lower sections of I-shaped notches, and wherein the tumbler is mounted at the middle of the I-shaped notches, and wherein return torque springs are symmetrically mounted in the grooves on the upper and lower sections of the I-shaped notches, and wherein tooth-tips of short gear teeth on both sides of the tumbler are arc-shaped, whose arc radius is approximate to the tubing radius, and the tooth end of a middle tooth is rounded; and wherein the upper and lower commutators comprise a sleeve, an open spacing ring, and a tower spring, wherein an open spacing ring of the upper commutator is mounted in a cone cannelure on the upper section of the sleeve, and wherein the tower spring is inverted in the cone cannelure on the lower section of the sleeve, and wherein the open spacing ring of the lower commutator is mounted in the inverted cone cannelure on the lower section of sleeve, and wherein the tower spring is mounted in the cone cannelure on the upper section of the sleeve.

2. The automatic paraffin removal unit of claim 1, wherein the staggered rectangular through-holes are fabricated adjacent a mounting hole of the tumbler respectively, and wherein the spacing ring is mounted in the staggered rectangular through-holes, and a steel ball is mounted to both ends of the staggered rectangular through-holes respectively.

3. The automatic paraffin removal unit of claim 2, wherein the tumbler is fabricated with a ring pit on an end of the mounting hole.

4. The automatic paraffin removal unit of claim 3, wherein the wear-resistant material is inlaid on an end of every sheet of the arc spring leaf.

5. An automatic paraffin removal device comprising:

a scraper positioned adjacent a pumping rod, wherein the scraper comprises a scraper body, at least one tumbler, at least one arc spring leaf, and at least one return torque spring, wherein the at least one arc spring leaf is mounted to the scraper body, and wherein notches having a middle section are opened on the scraper body, and wherein at least one screw cutting edge is mounted adjacent the notches, and wherein grooves are opened at the upper and lower sections of the notches, and wherein the tumbler is mounted adjacent the middle section of the notches, and wherein the at least one return torque spring is mounted adjacent the grooves of the notches; and an upper and lower commutator connected to both ends of a tubing segment from a well head to a section having a temperature lower than paraffin deposition temperature which requires paraffin removal.

6. The device of claim 5, wherein the at least one arc spring leaf comprises three rows of staggered rectangular through-holes and three sheets, which are mounted on upper and lower ends of the scraper body such that their relative positions are staggered 60 degrees over the three rows of staggered rectangular through-holes.

7. The device of claim 6, wherein the scraper body further comprises a circle and the notches are opened on the circle of the scraper body.

8. The device of claim 7, wherein the scraper body further comprises screw cutting edges having positions staggered 60 degrees, which are mounted on both the upper and lower ends of the scraper body in which staggered round pits are mounted on both sides of the notches.

9. The device of claim 8, wherein inward slotted grooves are opened at the upper and lower sections of the notches.

10. The device of claim 9, wherein the tumbler is mounted at the middle of the notches.

11. The device of claim 10, wherein the return torque springs are symmetrically mounted in the grooves on the upper and lower sections of the notches.

12. The device of claim 11, wherein the tumbler further comprises short gear teeth having tooth-tips, which are positioned adjacent to both sides of the tumbler and are arc-shaped such that the arc radius is approximate to the tubing radius of the tubing segment.

13. The device of claim 12, wherein the short gear teeth comprises a middle tooth, wherein a tooth end of middle tooth is rounded.

14. The device of claim 13, wherein the spacing ring is mounted in the staggered rectangular through-holes, and a ball is mounted to both ends of the staggered rectangular through-holes respectively.

15. The device of claim 14, wherein the ball is a steel ball.

16. The device of claim 14, wherein the tumbler is fabricated with a ring pit on an end of the mounting hole.

17. The device of claim 16, wherein the wear-resistant material is inlaid on an end of every sheet of the at least one arc spring leaf.

18. The device of claim 5, wherein the notches are I-shaped notches.

19. The device of claim 5, wherein the grooves are inward slotted grooves.

20. The device of claim 5, wherein the upper and lower commutators comprise a sleeve, an open spacing ring, and a tower spring.

21. The device of claim 20, wherein the sleeve having an upper section and a lower section comprises a cone cannelure.

22. The device of claim 21, wherein the open spacing ring of the upper commutator is mounted in the cone cannelure on the upper section of the sleeve.

23. The device of claim 22, wherein the tower spring is inverted in the cone cannelure on the lower section of the sleeve.

24. The device of claim 23, wherein the open spacing ring of the lower commutator is mounted in the cone cannelure on the lower section of the sleeve.

25. The device of claim 24, wherein the tower spring is mounted in the cone cannelure on the upper section of the sleeve.

26. The device of claim 5, wherein the at least one return torque spring is symmetrically mounted in the grooves of the notches.

27. The device of claim 5, wherein the middle section of the notches comprises a mounting hole.

28. The device of claim 27, wherein the tumbler is mounted adjacent the middle section of the notches in the mounting hole.

29. An automatic paraffin removal device comprising:

a scraper positioned adjacent a pumping rod, wherein the scraper comprises a scraper body, at least one tumbler, at least one arc spring leaf, and at least one return torque spring, wherein the at least one arc spring leaf is mounted to the scraper body, and wherein notches are opened on the scraper body, and wherein at least one screw cutting edge is mounted adjacent the notches, and wherein the tumbler is mounted adjacent the notches in a mounting hole, and wherein the at least one return torque spring is mounted adjacent the notches; and an upper and lower commutator connected to both ends of a tubing segment from a well head to a section having a temperature lower than paraffin deposition temperature which requires paraffin removal.

* * * * *